US006153345A

United States Patent [19]

Soeda et al.

[11] Patent Number: 6,153,345

[45] Date of Patent: Nov. 28, 2000

[54] COLORED TONER FOR ELECTROPHOTOGRAPHY

[75] Inventors: Kaori Soeda; Meizo Shirose, both of Hachioji, Japan

[73] Assignee: Konica Corporation, Japan

[21] Appl. No.: 09/248,817

[22] Filed: Feb. 11, 1999

[30] Foreign Application Priority Data

Feb. 19, 1998 [JP] Japan ..... 10-037215

[51] Int. Cl.[7] ..... G03G 9/09

[52] U.S. Cl. ..... 430/106

[58] Field of Search ..... 430/106, 110

[56] References Cited

U.S. PATENT DOCUMENTS

| | | | |
|---|---|---|---|
| 5,286,592 | 2/1994 | Johnston et al. | 430/106 |
| 5,292,621 | 3/1994 | Johnston et al. | 430/106 |
| 5,916,721 | 6/1999 | Soeda et al. | 430/106 |

*Primary Examiner*—Christopher D. RoDee
*Attorney, Agent, or Firm*—Jordan B. Bierman; Bierman, Muserlian and Lucas

[57] ABSTRACT

Disclosed is a color toner for developing an electrostatic latent image, wherein the colorant comprises a metal complex dye represented by Formula:

Formula 1 wherein X is represented by Formula 2.

Formula 2

The definitions are specified in the specification.

18 Claims, No Drawings

COLORED TONER FOR ELECTROPHOTOGRAPHY

FIELD OF THE INVENTION

The present invention relates to a colored toner which is employed in color copying machines and color printers utilizing an electrophotographic process.

BACKGROUND OF THE INVENTION

Conventionally, in color copiers and color printers utilizing the electrophotographic method, a toner has been generally employed wherein a colorant is dispersed into resin particles.

Another toner is also employed wherein the colorant is adhered on the surfaces of resin particles. For example, Japanese Patent Publication open to Public Inspection Nos. 63-23166, 63-2075 and 4-243267 propose methods wherein the colorant is mechanically or chemically adhered on. However, according to such methods, the surface of the toner is only colored and it is difficult to obtain the sufficient coloring effect. Furthermore, problems have been caused such that the description, etc. is caused on the surface and electrification properties vary, and in the above-mentioned system in which a heat roller is employed, the roller surface is stained.

Accordingly, the toner has been widely employed wherein the colorant is dispersed into the interior of a resin particle.

As properties required for color tone of such the toner, not only color reproduction and image transparency for an overhead projector (hereinafter referred to as OHP) but also light fastness is enumerated in order to maintain consistently these properties.

The above-mentioned OHP image transmission rate means the OHP image transmission rate, and a degree of the variation in hue between the color of light transmitted through the OHP image and the color of light obtained by the reflection of the transmitted light on paper. When a toner comprising a pigment as the colorant is employed, good light fastness is obtained. However, on account of insolubility of the pigment, a dispersed particle having a diameter of tens of nm to hundreds of nm is formed and problems such as the decrease in the transparency and the hue variation in the color of transmitted light are caused. When the toner is employed which comprises a pigment such as C.I. PIGMENT RED 48:1 or C.I. PIGMENT RED 122, the pigment is insoluble and tends to coagulate to form dispersed particle having a diameter of tens of nm to hundreds of nm through the secondary particle and further tertiary particle. As a result, problems such as the decrease in saturation and transparency of the OHP image are caused.

As the countermeasures against those, the pigment is previously treated by a flushing method, a master batch method, etc. and the resulting treated pigment has been employed. When employing the countermeasure, the increase in cost is not avoided because of the increase in the number of the manufacturing process.

On the other hand, when the toner comprising a dye as the colorant is employed, the transparency of the OHP image is excellent because the dye is soluble and is fully dispersed. However, there is provided a problem such that the light fastness is inferior to that of the pigment. There have been known dyes such as C.I. SOLVENT RED 49 or C.I. SOLVENT RED 52. These dyes enable to obtain the OHP image having high transparency and no hue variation. However, as compared to the pigment, the light fastness is inferior and the consistent properties cannot be obtained for a long period of time.

SUMMARY OF THE INVENTION

An object of the present invention is to provide a colored toner which results in an image having high saturation without previous treatment of a colorant, excellent light fastness, and small variation in hue and high transparency of an OHP image.

The colored toner of the present invention comprises a metal complex dye.

In a colored toner comprising at least a resin and a colorant, the color toner for electrophotography wherein said colorant comprises at least a metal complex dye represented by Formula:

Formula 1

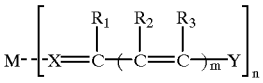

wherein X is represented by Formula 2.

Formula 2

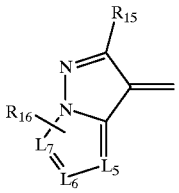

In the Formulas, $L_5$ represents a nitrogen atom or a group of —$CR_{17}$=, $L_6$ represents a nitrogen atom or a group of —$CR_{18}$=, and $L_7$ represents a nitrogen atom or a group of —$CR_{19}$=. $R_{15}$, $R_{16}$, $R_{17}$, $R_{18}$ and $R_{19}$ each represent a hydrogen atom or a monovalent substituent, and at least one of $R_{17}$, $R_{18}$ and $R_{19}$ represents an atomic group capable of forming bidentate coordinate bond with a nitrogen atom in the Formula 2.

$R_1$, $R_2$ and $R_3$ each represent a hydrogen atom or a monovalent substituent.

Y represents an aromatic hydrocarbon ring or a 5 or 6 member heterocycle.

M is a metal ion capable of forming a bidentate or polydentate bond with the atomic group formed by X.

m is an integer of 1, 2 or 3, n is an integer of 1, 2 or 3.

At least one of $L_5$, $L_6$, and $L_7$ is preferably a nitrogen atom. Two of $L_5$, $L_6$, and $L_7$ are each a nitrogen atom more preferably.

The atom formed by X is preferably a nitrogen atom.

Preferable examples of M includes an ion derived from metal of Ni, Cu, Co, Cr, Zn, Fe, Pd or Pt.

The more examples of M are Ni and Zn, and the most preferable example is Ni.

Preferable example of the is represented by the formula.

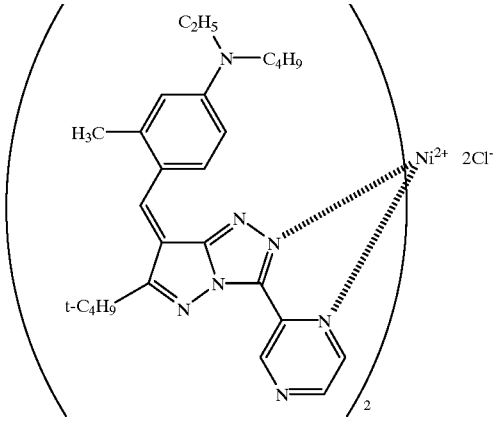

DETAILED DESCRIPTION OF THE INVENTION

In the Formula 1, X is preferably the following Formulas 3, 4, 5, or 6.

Formula 3

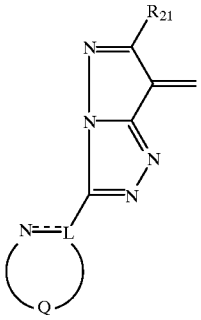

Formula 4

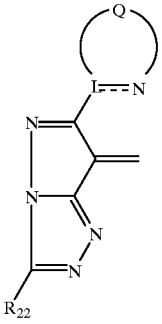

Formula 5

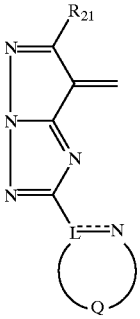

-continued

Formula 6

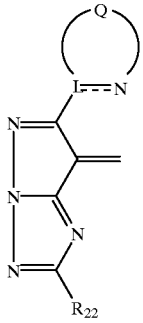

In the Formulas $R_{21}$ and $R_{22}$ independently represent a hydrogen atom, a halogen atom such as a chlorine atom and a bromine atom, or a mono-valent substituent such as an alkyl, aryl, heterocycle, acyl, amino, nitro, cyano, acylamino, alkoxy, hydroxy and alkoxycarbonyl group, Q is an atomic group necessary for forming a heterocycle.

In the formula 1 a preferable example of Y includes a phenyl, furanyl, pyrrolyl, thiophenyl, pyrazolyl, imidazolyl, triazolyl, thiadiazolyl, oxazolyl, thiazolyl, pyranyl, pyridinyl, pyridazinyl, pyrimidinyl, pyrazinyl, triazinyl, naphthalenyl, benzofuranyl, indolyl, benzothiophenyl, benzimidazolyl, benzothiazolyl, benzoxazolyl, purinyl, quinolinyl, isoquinolinyl, coumalinyl or chromonyl.

$R_1$, $R_2$ and $R_3$ independently represent a hydrogen atom, a halogen atom such as a chlorine atom and a bromine atom, or a mono-valent substituent such as an alkyl, alkoxy, cyano, alkoxycarbonyl, aryl, heterocycle, carbamoyl, hydroxy, acyl and acylamino group. The most preferable example is a hydrogen atom.

Above Formulas 3 to 6, most preferable example is that represented by Formula 3.

Example of the dye are illustrated.

D-1

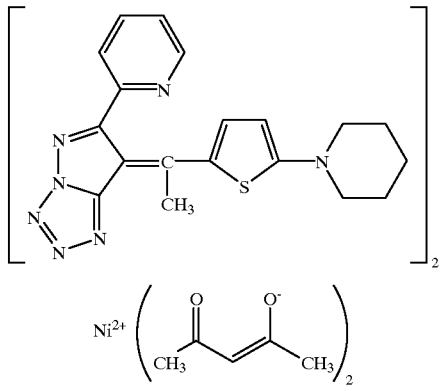

D-2

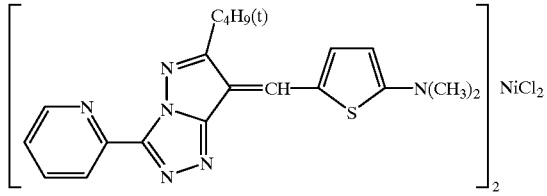

-continued
D-3
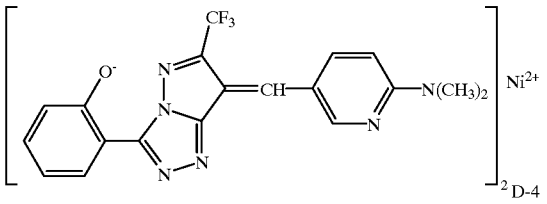
D-4
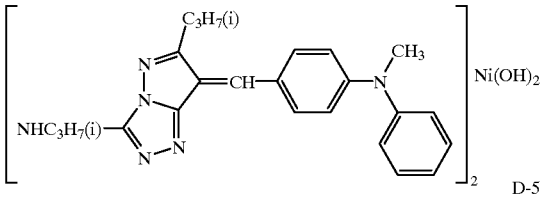
D-5
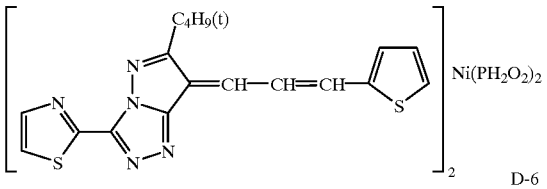
D-6
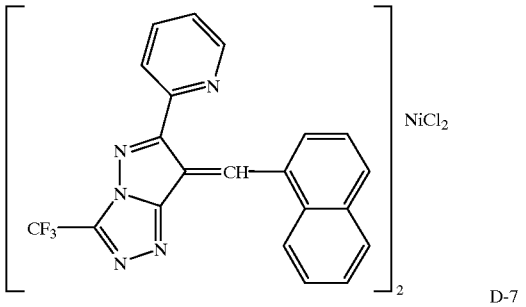
D-7
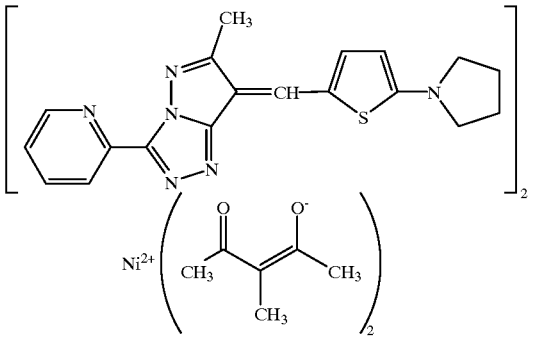
D-8
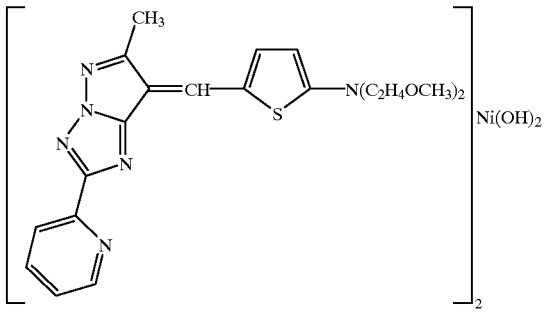
-continued
D-9
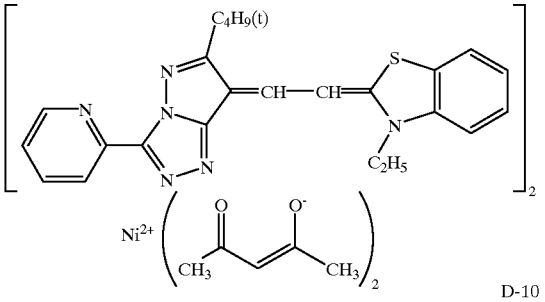
D-10
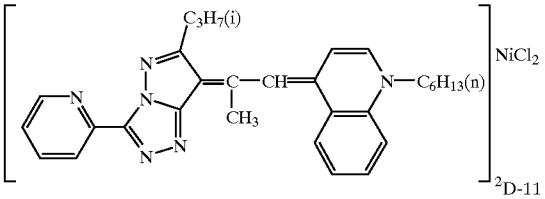
D-11
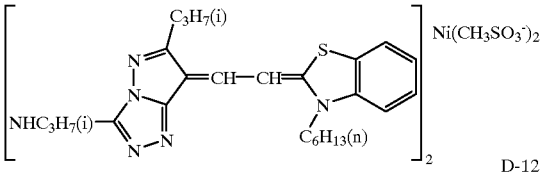
D-12
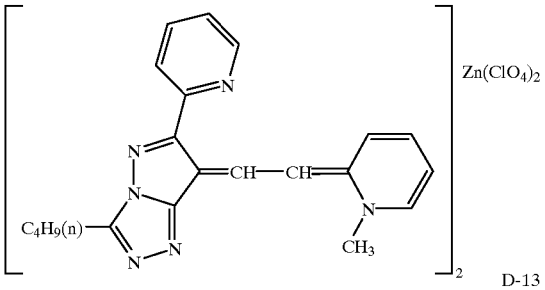
D-13
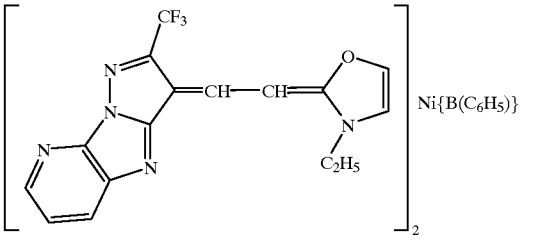
D-14
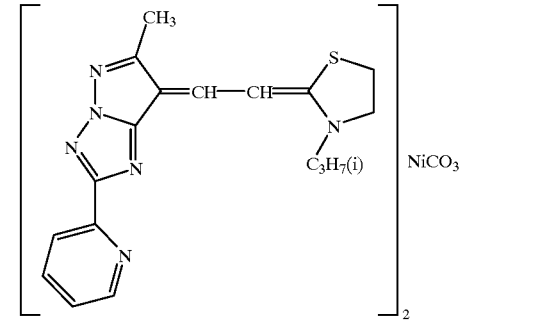

-continued

D-15

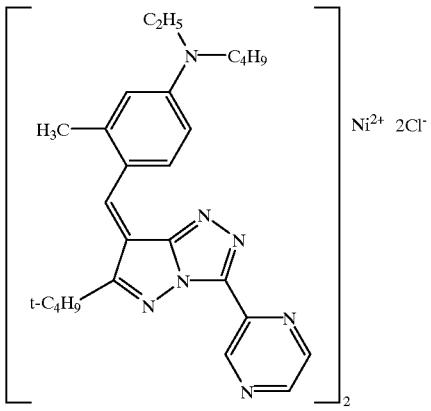

Preferable example of the metal complex dye is D-15.

An addition amount of the metal complex dye of the present invention to a toner is 0.01 to 15 parts by weight and preferably 1.0 to 10 parts by weight to a binder resin (or binding resin).

As the binder resin for the toner, can be employed all the binders generally used. For example, are illustrated styrene resins, acryl resins, styrene/acryl resins, polyester resins, etc.

In the present invention, inorganic fine particles and organic fine particles may be externally added for the improvement in fluidity, charge control, etc. for the toner. Silica fine particles and titania fine particles are preferably employed of which surfaces are treated with a coupling agent containing an alkyl group and the like. Further, the number average primary particle diameter of these particles is preferably 10 to 500 nm and the addition amount to the toner is preferably 0.1 to 20 weight percent.

As release agents, may be employed all the release agents conventionally used. Specifically, are illustrated olefins such as low molecular weight polypropylene, low molecular weight polyethylene, ethylene-propylene copolymer, etc., microcrystalline wax, carnauba wax, sazor wax, paraffin wax, etc. An addition amount of these is preferably 1 to 5 weight percent of the toner.

A charge control agent may be added as required. However, the colorless agent is preferable from the point of the formation of color. For example, are illustrated agents having a quartenary ammonium salt structure, Calixarene structure, etc.

Toner of the invention may be prepared by pulverization or polymerization. According to the pulverization method, after binder resin for toner, colorant and other additives are fused and kneaded, the resultant is pulverized and classified.

Polymerization employed in the Polymerization method includes suspension polymerization, emulsion polymerization and similar method thereto. An example of suspension polymerization is a method in which a colorant and other additives are dispersed in monomer (dispersion step), a droplet of the monomer is formed by primary agitation in aqueous phase, and then monomer droplets are polymerized by second agitation (polymerizing step).

According to an example of emulsion polymerization, monomer is polymerized in aqueous solvent to form primary particles having particle size of submicron (polymerizing step), then colorant and other additives are added so that they are adsorbed on the surface of the primary particles, the primary particles are associated to form second particles having particle size of several micron (particle forming step), the secondary particles are heated up to glass transition point of the polymer whereby the secondary particles are fused to form toner particles (ripening step). The resulted toner by the polymerization method is washed, dryed, and if necessary, broken to obtain suitable particle size. Then additives such as fluidity improving agent and improver of cleaning characteristics are added to the particles if necessary.

As a carrier, either non-coated carrier composed of only particles of a magnetic material such as iron, ferrite, etc. or resin coated carrier wherein the surfaces of magnetic particles are covered with a resin, etc. may be employed. The average diameter of the carrier is preferably 15 to 150 $\mu$m in a volume average diameter.

No imaging method to which the toner of the present invention is applied is particularly limited. For example, there are provided methods wherein a color image is repeatedly formed on a photoreceptor and thereafter, the resulting images are transferred to form the color image, or an image formed on a photoreceptor is successively transferred to an intermediate transfer member and a color image is formed on the intermediate transfer member and thereafter, the color image is formed by transferring the resulting color image to a image forming material such as paper, etc.

EXAMPLE

In the following, the present invention is explained in detail with the reference to examples. However, it should be noted that the embodiments of the present invention are not limited by the examples herein. Furthermore, "parts" hereinafter are "by weight", unless otherwise indicated.

Preparation of Samples

Colorant

Metal complex dyes of the present invention (D-15)

Comparative Pigment 1 C.I. PIGMENT RED 48:1

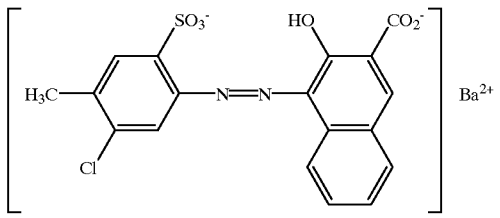

Comparative Pigment 2 C.I. PIGMENT RED 122

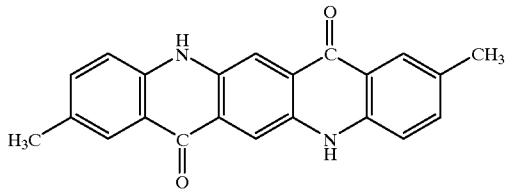

Comparative Pigment 3 C.I. PIGMENT RED 49

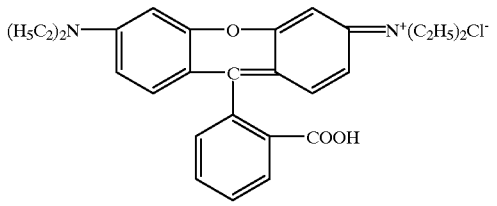

Preparation of Colored Toner 1, Pulverization Method

One hundred parts of a polyester resin, 8 parts indicated above of each colorant and 3 parts of polypropylene were mixed, kneaded, pulverized and classified, and powder having a volume average particle diameter of 8.5 $\mu$m was obtained.

Furthermore, 100 parts of the powder and 1.0 part of silica fine particles (particle size of 12 nm, a degree of hydrophobicity 60) were mixed in a Henschel mixer and the colored toner was obtained.

Preparation of Colored Toner 1, Polymerization Method

Each of 20 g of the colorant mentioned above was added to solution which was prepared by dissolving 5 g of sodium dodecylsulfate in 200 ml of deionized water, and then agitation and ultrasonic wave was given to the mixture so that an aqueous dispersion of the magenta colorant was prepared.

To low molecular weight polypropylene having an average molecular weight of 3,200, surfactant was added with heating to form an emulsion so that the polypropylene is emulsified in water having solid content of 30 weight %.

To the above mentioned colorant dispersion, 60 g of low molecular polypropylene emulsion was added and mixed, further, 220 g of styrene monomer, 40 g of n-butylacrylate monomer, 12 g of methacrylic acid monomer, 5.4 g of t-dodecylmercaptan as a chain transfer agent and 2000 ml of deaerated deionized water were added, then the mixture was agitated in a circumstances of nitrogen gas at 70° C. for 3 hours to conduct emulsion polymerization to obtain dispersion of fine resin particles containing magenta colorant.

To 1000 ml of the resulted dispersion of fine resin particles containing magenta colorant aqueous sodium hydroxide was added so as to adjust to have pH being 7.0. Then 270 ml of 2.7 mol % potassium chloride and an aqueous solution prepared by dissolving 160 ml of isopropyl alcohol and 9.0 g of polyoxyethyleneglycol phenylether having average ethyleneoxide polymerization degree in 67 ml of deionized water was added, the mixture was agitated for 6 hors at 75° C. to conduct reaction. The resulted reactant was filtrated and washed with water, dryed and broken and colored particles were obtained.

The colored particles and silica fine particles (particle size of 12 nm, a degree of hydrophobicity 60) 1.0% by weight to the colored particles were mixed in a Henschel mixer and the colored toner was obtained.

Preparation of Carrier

Forty g of fine particles of a copolymer of styrene/methylmethacrylate=4/6, 1960 g of Cu—Zn ferrite particles having a specific gravity of 5.0, a weight average particle size of 45 $\mu$m, and a saturation magnetization of 62 emu/g at the application of external magnetic field of 1,000 oersted were placed in a mixer with a high speed stirrer and mixed at 30° C. for 15 minutes. The resulting mixture was subjected repeatedly to mechanical impact force for 30 minutes at 105° C. and cooled. Thus, the carrier was prepared.

Preparation Developer

In a V type mixer, 214 g of the above-mentioned carrier and 16 g of each toner were mixed for 20 minutes and developers for specific copying tests were prepared. They are shown in the Table 1.

TABLE 1

| Colorant | Toner by pulverization | Toner by polymerization |
|---|---|---|
| D-15 (Invention) | Sample 1-1 | Example 1-2 |
| Comparative Pigment 1 | Comparative Sample 1-1 | Comparative Sample 1-2 |
| Comparative Pigment 2 | Comparative Sample 2-1 | Comparative Sample 2-2 |
| Comparative Pigment 3 | Comparative Sample 3-1 | Comparative Sample 3-2 |

Evaluation Apparatus and Conditions

In Example, the specific copying evaluation was performed using a color copying machine Konica KL-2010, manufactured by Konica Corp. as an imaging apparatus.

A usually employed heat roller fixing apparatus was employed. The fixing apparatus comprises a PFA coated aluminum roller having diameter of 30 mm and wall thickness of 5 mm as an upper roller and a PFA coated aluminum hollow roller having diameter of 30 mm and comprising a heater inside as the lower roller.

Evaluation Items, Methods

Reflection images (image on plain paper) and transmission images (OHP image) were prepared by the above-mentioned imaging method with the use of the colored toners of the present invention. The resulting images were evaluated by the following method.

The evaluation was performed under the range of toner adhesion of 0.7±0.05 mg/cm$^2$.

Chroma

The chroma of the image on plain paper was measured using the Macbeth Color-Eye 7000 wherein ASTM D65 2* Visible region was mounted as a light source and results were compared.

Transparency

The transparency of the OHP image was evaluated by the following method.

The spectral transmittance of visible region of the image was measured using "330 Type Automatic Recording Spectrophotometer manufactured by Hitachi, Ltd., while utilizing the OHP transparency having no toner image as a reference and the spectral transmittances at 650 nm were obtained thereby to make a scale for the evaluation of the transparency of the OHP image.

Light Fastness

The exposure test for 7 days was conducted using the "Xenon Long Life Weather Meter" manufactured by Suga Shikenki Co. (Xenon arc lamp, 70,000 lux, 44.0° C.). Thereafter, the difference in color between before and after the test was measured by the use of Macbeth Color-Eye 7000, and then, the color difference was calculated by CMC (2:1) color difference equation and compared.

Evaluation Results

Table 2 shows the obtained results.

TABLE 2

| | Chroma | Transparency [%] | Light Fastness |
|---|---|---|---|
| Example 1-1 | 83.4 | 67.8 | 0.5 |
| Comparative Example 1-1 | 60.7 | 54.3 | 4.1 |

TABLE 2-continued

| | Chroma | Transparency [%] | Light Fastness |
|---|---|---|---|
| Comparative Example 2-1 | 67.2 | 58.0 | 0.1 |
| Comparative Example 3-1 | 80.1 | 64.2 | 15.8 |
| Example 1-2 | 84.4 | 72.5 | 0.4 |
| Comparative Example 1-2 | 62.1 | 55.6 | 5.0 |
| Comparative Example 2-2 | 65.5 | 60.1 | 0.5 |
| Comparative Example 3-2 | 79.7 | 68.4 | 18.4 |

As clearly shown in Table 1, with the use of the colored toner of the present invention, the faithful color reproduction and high OHP quality are obtained. Accordingly, the colored toner of the present invention is suitably utilized for full color process. Furthermore, because the light fastness is excellent, it is possible to prepare the image which can be displayed for a long period of time.

What is claimed is:

1. A color toner for developing an electrostatic latent image comprising a binder resin and a colorant, wherein the colorant comprises a metal complex dye represented by Formula:

Formula 1

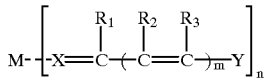

wherein X is represented by Formula 2,

Formula 2

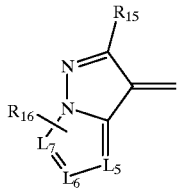

wherein the Formulas, $L_5$ represents a nitrogen atom or a group of —$CR_{17}$=, $L_6$ represents a nitrogen atom or a group of —$CR_{18}$=, and $L_7$ represents a nitrogen atom or a group of —$CR_{19}$=, $R_{15}$, $R_{16}$, $R_{17}$, $R_{18}$ and $R_{19}$ each represent a hydrogen atom or a monovalent substituent, and at least one of $R_{17}$, $R_{18}$ and $R_{19}$ represents an atomic group capable of forming bidentate coordinate bond with a nitrogen atom in the Formula 2, $R_1$, $R_2$ and $R_3$ each represent a hydrogen atom or a monovalent substituent, Y represents an aromatic hydrocarbon ring or a 5 or 6 member heterocycle, M is a metal ion capable of forming a bidentate or polydentate bond with the atomic group formed by X, m is an integer of 1, 2 or 3, and n is an integer of 1, 2 or 3.

2. A color toner of claim 1, wherein at least one of $L_5$, $L_6$, and $L_7$ is a nitrogen atom.

3. A color toner of claim 2, wherein two of $L_5$, $L_6$, and $L_7$ are each a nitrogen atom.

4. A color toner of claim 1, wherein M is an ion derived from metal of Ni, Cu, Co, Cr, Zn, Fe, Pd or Pt.

5. A color toner of claim 1, wherein M is an ion derived from metal of Ni or Zn.

6. A color toner of claim 1, wherein N is an ion derived from metal of Ni.

7. A color toner of claim 1, wherein an amount of the metal complex dye in the toner is 0.01 to 15 parts by weight based on the binder.

8. The color toner of claim 7 wherein the amount of the metal complex dye in the toner is 1.0 to 10 parts by weight based on the binder.

9. A color toner of claim 1 wherein the toner comprises inorganic fine particles or organic fine particles.

10. A color toner of claim 9 wherein the inorganic fine particles are silica or titania.

11. A color toner of claim 9 wherein a number average primary particle diameter of the fine particles is 10 to 500 nm.

12. A color toner of claim 9 wherein the amount of the fine particles is 0.1 to 20 weight percent based on the toner.

13. A color toner of claim 1 wherein the toner comprises release agent.

14. A color toner of claim 13 wherein the release agent is olefin, microcrystalline wax, carnaubau wax, or paraffin wax.

15. A color toner for developing an electrostatic latent image comprising a binder resin and a colorant, wherein the colorant comprises a metal complex dye selected from the group consisting of

D-1

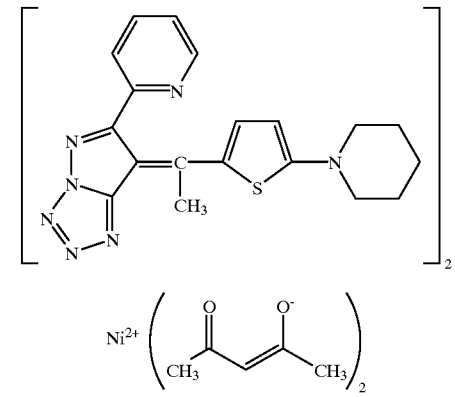

D-2

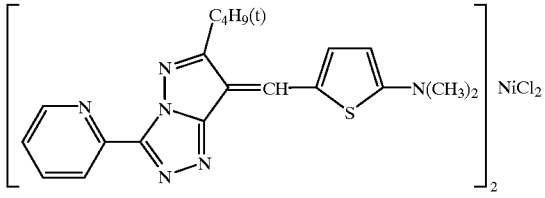

D-3

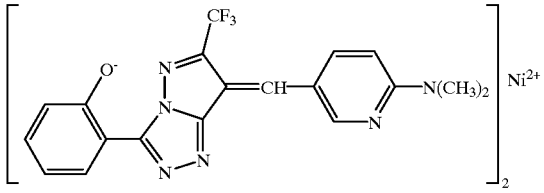

-continued
D-4
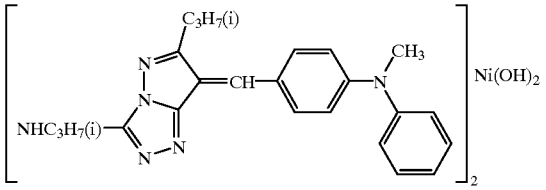
D-5
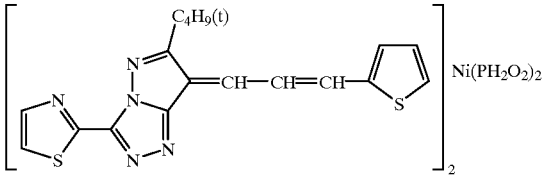
D-6
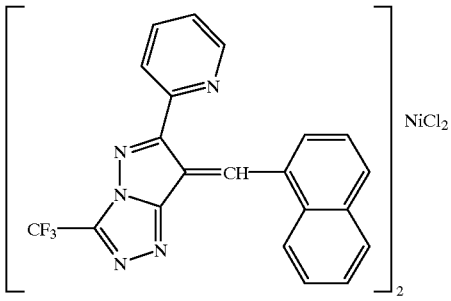
D-7
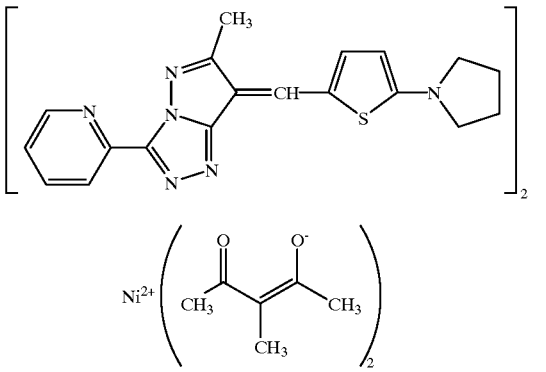
D-8
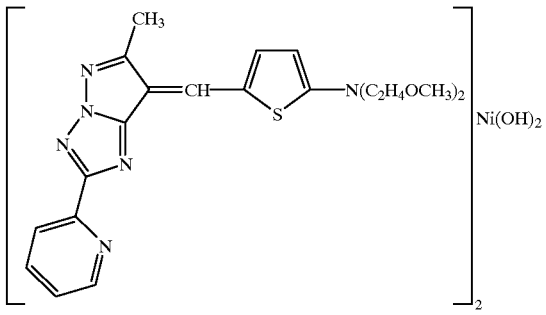
-continued
D-9
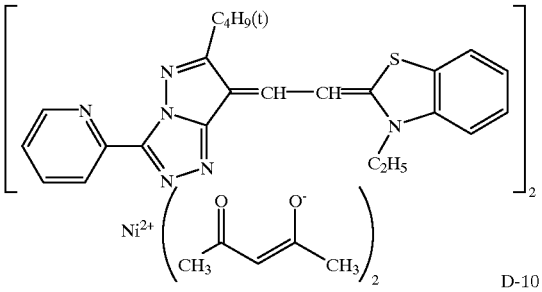
D-10
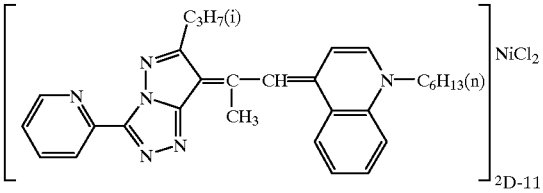
D-11
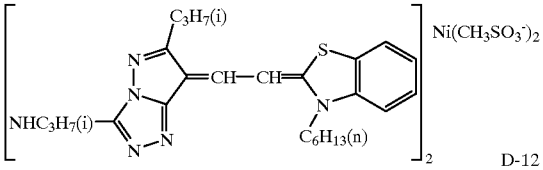
D-12
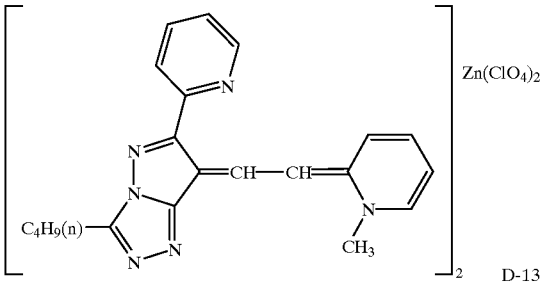
D-13
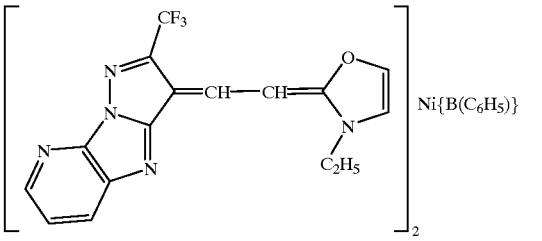
D-14
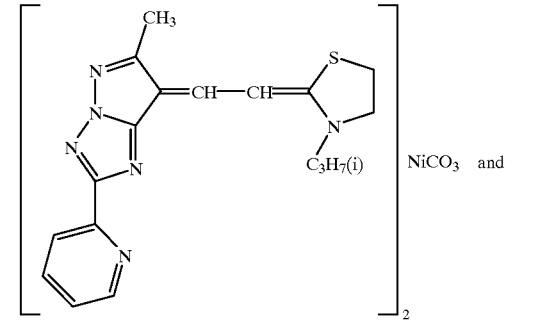
and -continued

D-15

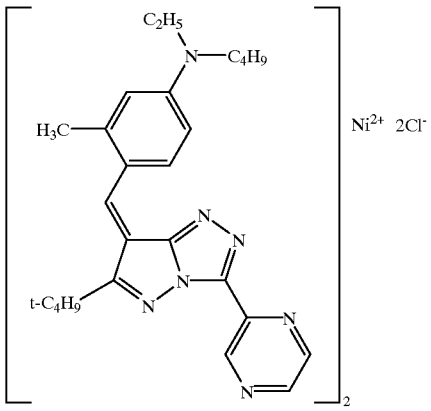

16. The color toner of claim 15 wherein the amount of the metal complex dye in the toner is 0.01 to 15 parts by weight based on the binder.

17. The color toner of claim 16 wherein the amount of the metal complex dye in the toner is 1.0 to 10 parts by weight based on the binder.

18. A color toner for developing an electrostatic latent image comprising a binder resin and a colorant, wherein the colorant comprises a metal complex dye represented by Formula:

Formula 1

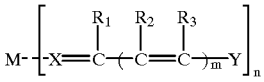

wherein X is represented by Formula 2,

Formula 2

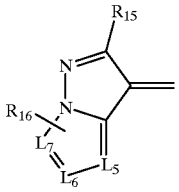

wherein the Formulas, $L_5$ represents a nitrogen atom or a group of —$CR_{17}$=, $L_6$ represents a nitrogen atom or a group of —$CR_{13}$=, and $L_7$ represents a nitrogen atom or a group of —$CR_{19}$=, $R_{15}$, $R_{16}$, $R_{17}$, $R_{18}$ and $R_{19}$ each represent a hydrogen atom or a monovalent substituent, and at least one of $R_{17}$, $R_{18}$ and $R_{19}$ represents an atomic group capable of forming bidentate coordinate bond with a nitrogen atom in the Formula 2, $R_1$, $R_2$ and $R_3$ each represent a hydrogen atom or a monovalent substituent, Y represents phenyl, furanyl, pyrrolyl, thiophenyl, pyrazolyl, imidazolyl, triazolyl, thiadiazolyl, oxazolyl, thiazolyl, pyranyl, pyridinyl, pyridazinyl, pyrimidinyl, pyrazinyl, triazinyl, naphthalenyl, benzofuranyl, indolyl, benzothiophenyl, benzimidazolyl, benzothiazolyl, benzoxazolyl, purinyl, quinolinyl, isoquinolinyl, coumalinyl or chromonyl.

* * * * *